US011520260B2

(12) United States Patent
Nishimura

(10) Patent No.: US 11,520,260 B2
(45) Date of Patent: Dec. 6, 2022

(54) SHEET SEPARATING DEVICE, FIXING DEVICE, AND IMAGE FORMING DEVICE

(71) Applicant: SHARP KABUSHIKI KAISHA, Sakai (JP)

(72) Inventor: Toshiki Nishimura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/367,243

(22) Filed: Jul. 2, 2021

(65) Prior Publication Data

US 2022/0026835 A1 Jan. 27, 2022

(30) Foreign Application Priority Data

Jul. 22, 2020 (JP) ..... JP2020-125491

(51) Int. Cl.
*G03G 15/20* (2006.01)
*G03G 15/01* (2006.01)

(52) U.S. Cl.
CPC ..... *G03G 15/2028* (2013.01); *G03G 15/0189* (2013.01)

(58) Field of Classification Search
CPC ..... G03G 15/0189
See application file for complete search history.

(56) References Cited

U.S. PATENT DOCUMENTS

2014/0029989 A1* 1/2014 Koda ..... G03G 15/2028 399/323

FOREIGN PATENT DOCUMENTS

JP 2012-098704 A 5/2012

* cited by examiner

*Primary Examiner* — Victor Verbitsky
(74) *Attorney, Agent, or Firm* — ScienBiziP, P.C.

(57) ABSTRACT

This sheet separating device 50 includes: a release member 51 provided facing a rotating member (such as a fixing belt 43) arranged on a sheet transport path, and which extends toward the surface of the rotating member; a support member 54 that supports both ends of the release member 51; and a separating tip portion 71 arranged between the release member 51 and the rotating member. The separating tip portion 71 is provided so as to make contact with the rotating member, and is swingably attached to the support member 54.

8 Claims, 16 Drawing Sheets

SHEET SEPARATING DEVICE, FIXING DEVICE, AND IMAGE FORMING DEVICE

BACKGROUND OF THE INVENTION

Field of the Invention

The present invention relates to a sheet separating device, and a fixing device and image forming device provided with the sheet separating device.

Description of the Background Art

Image forming devices such as copiers and printers that form an image on a sheet by an electrophotographic image forming process include a fixing device that fixes a toner image on the surface of a recording sheet. A fixing device includes rotating members such as heating rollers and pressure rollers which have peripheral surfaces that make pressing contact with each other to form a fixing nip area. A sheet is transported in a direction that passes through the fixing nip area, and the toner image transferred onto the surface of the sheet is melted and then fixed.

In a fixing device, when fixing a toner image on a sheet, a release member such as a release claw or a release plate is sometimes used to release the sheet from a rotating member. This type of release member is configured to separate the sheet from a rotating member while making contact with the rotating member. However, there is a concern that fixed residual toner and the like may adhere to, and solidify on, the contact portion of the release member, thereby damaging the rotating member and causing image loss. Therefore, for example, as disclosed in Japanese Unexamined Patent Application Publication No. 2012-98704, proposed is a technique where abutting members are arranged on both ends of the release member to enable it to be arranged as close to the fixing roller as possible without making contact with the fixing roller.

However, the gap between the tip portion of such a release member and the surface of a rotating member tends to be difficult to maintain evenly in the axial direction of the rotation axis of the rotating member due to deviations and the like in the mounting position of the support members that support the release member. In the conventional release member, there is a concern that the gap at the tip portion may become wider than the expected dimension when tip portion of the release member becomes bent, or the release member is attached at an angle, thereby causing a paper jam. In such a case, it is necessary to take out the fixing device and use a tool or the like to adjust the gap between the tip portion of the release member and the surface of the rotating member.

Furthermore, when separate abutting members are provided as disclosed in Japanese Unexamined Patent Application Publication No. 2012-98704, it is necessary to secure a space for arranging the abutting members. Therefore, it becomes necessary to increase the axial direction length of the rotating member, which causes a problem in that it becomes difficult to reduce the size of the device.

The present invention has been made in view of the above problems. An object of the present invention is to provide a sheet separating device which is capable of accurately managing a gap between the tip portion of a release member and the surface of a rotating member, and reducing the size of the device, and a fixing device and an image forming device provided with the sheet separating device.

SUMMARY OF THE INVENTION

A sheet separating device of the present invention for achieving the object above includes: a rotating member that sandwiches a sheet with an opposing member, and transports the sheet by rotating; a release member which has a plate shape and is arranged along a rotation axis direction of the rotating member, and which includes, downstream of a sheet sandwiching part of the rotating member in a sheet transport direction, a tip portion that extends toward the rotating member; support members that each support the release member at both ends in the rotation axis direction; and a separating tip portion which is arranged so as to make contact with each of the tip portion of the release member and the rotating member, and which is swingably attached with respect to each of the support members.

This particular matter enables a predetermined gap to be formed by interposing the separating tip portion between the tip portion of the release member and the surface of the rotating member. Therefore, it is possible to accurately manage the gap between the tip portion and the surface of the rotating member regardless of the state of the release member.

More specific configurations of the sheet separating device include the following. That is to say, it is preferable that the separating tip portion is provided with a sliding contact portion having a first contact surface that makes contact with the tip portion of the release member, and a second contact surface that makes contact with the surface of the rotating member, and a thickness between the first contact surface and the second contact surface decreases toward an upstream side in a rotational direction of the rotating member.

As a result, the thickness can decrease toward the end of the separating tip portion on the contact side with the rotating member, and the gap between the tip portion of the release member and the surface of the rotating member can be set narrower.

Furthermore, in the sheet separating device above, it is preferable that the separating tip portion is provided with an opposing portion on a downstream side in a rotational direction of the rotating member that extends so as to not make contact with the release member, the opposing portion is provided with a first protrusion which projects toward the support members, and the support members are provided with a storage portion that accommodates the first protrusion and swingably holds the separating tip portion. Consequently, the separating tip portion can be more stably held, and can be swingably arranged.

In addition, in the sheet separating device above, it is preferable that the opposing portion is further provided with a second protrusion that projects toward the release member, and the release member is provided with a regulator that accommodates the second protrusion and regulates a range of movement of the second protrusion with respect to the release member. Consequently, the separating tip portion can be more stably held, and can be swingably arranged in the range of movement.

Moreover, in the sheet separating device above, it is preferable that the release member is provided with a support plate which is fixed to the support members, and a release plate which is attached to the support plate and is made of a plate material which is thinner than the support plate, and an end of the release plate on the rotating member side is provided so as to project further from an end of the support plate on the rotating member side, and constitutes the tip portion. As a result, the gap between the tip portion of the release member and the surface of the rotating member can be set narrower.

Also, in the sheet separating device above, it is preferable that the separating tip portion has a third contact surface which is provided so as to face an end of the support plate on the rotating member side. Consequently, the separating tip portion can be more stably held, and can be swingably arranged within a predetermined range.

Furthermore, in the sheet separating device above, it is preferable that the support member is provided with a fixing portion on one end to which the release member is fixed, and a locking portion of a biasing member on another end, and is rotatably supported around a rotation center between the fixing portion and the locking portion, and the release member is biased in a surface direction of the rotating member. As a result, the tip portion of the release member can be arranged near the surface of the rotating member.

Moreover, a fixing device and an image forming device that include the sheet separating device are also within the scope of the technical idea of the present invention. That is to say, the fixing device may have a configuration in which the rotating member is a fixing roller which fixes an unfixed image on a sheet while transporting the sheet with a pressing member. Alternatively, the fixing device may have a configuration in which the rotating member is an endless fixing belt that fixes an unfixed image on a sheet while transporting the sheet, and an opposite side of the fixing belt at a position corresponding to the release member makes contact with a fixing roller having an elastic layer on a surface.

According to the present invention, it is possible to accurately manage the gap between the tip portion of the release member and the surface of the rotating member, which enables paper jams to be prevented and a reduction in size of the device to be achieved.

DESCRIPTION OF THE PREFERRED EMBODIMENTS

A sheet separating device according to an embodiment of the present invention, and a fixing device and an image forming device provided with the sheet separating device will be described with reference to the drawings.

Overall Configuration of Image Forming Device

Figure 1:
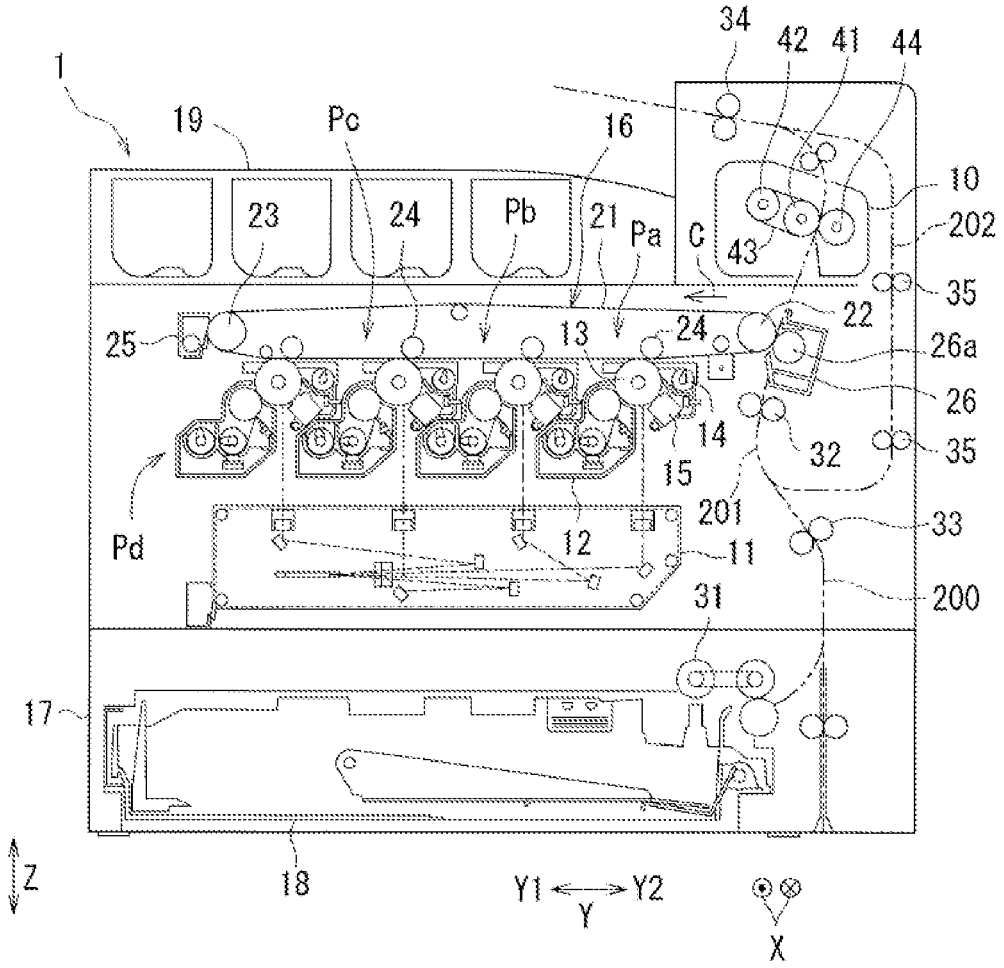
FIG. 1 is a schematic explanatory view showing an image forming device according to an embodiment of the present invention.

FIG. 1 is a schematic explanatory view showing an image forming device 1 provided with a fixing device 10 according to an embodiment of the present invention. Note that, in FIG. 1, the reference sign X represents the axial direction X of a rotation axis of a rotating member described below, which in other words is the rotation axis direction X (in FIG. 1, a direction corresponding to the orthogonal direction to the paper surface). The reference sign Y represents the left-right direction, which is orthogonal to the axial direction X when the image forming device 1 is viewed as shown in FIG. 1. The reference sign Z represents the up-down direction.

The image forming device 1 according to the present embodiment has a configuration including a fixing device 10, an exposure device 11, a developing device 12, a photoconductor drum 13, a cleaner device 14, a charger 15, an intermediate transfer belt device 16, a paper feeder 17, a paper discharge tray 19, and a sheet transport path 200, and forms multicolor and monochromatic images on a predetermined sheet according to image data transmitted from the outside.

The image data handled by the image forming device 1 corresponds to a color image using each of black (K), cyan (C), magenta (M), and yellow (Y). Four developing devices 12, photoconductor drums 13, chargers 15, and cleaner devices 14 are provided so as to form four types of latent images corresponding to each of the colors. These are set to each of black, cyan, magenta, and yellow, thereby constituting four imaging stations Pa, Pb, Pc and Pd.

The photoconductor drum 13 is arranged substantially in the center of the image forming device 1. The charger 15 uniformly charges the surface of the photoconductor drum 13 to a predetermined potential. The exposure device 11 exposes the surface of the photoconductor drum 13 to form an electrostatic latent image. The developing device 12 develops the electrostatic latent image on the surface of the photoconductor drum 13 to form a toner image on the surface of the photoconductor drum 13.

As a result of the series of operations described above, a toner image of each color is formed on the surface of each photoconductor drum 13. The cleaner device 14 removes and collects residual toner on the photoconductor drum 13 after development and image transfer.

The intermediate transfer belt device 16 is arranged above the photoconductor drum 13, and includes an intermediate transfer belt 21, an intermediate transfer belt drive roller 22, an intermediate transfer belt-driven roller 23, a transfer roller 24, and an intermediate transfer belt cleaning device 25. A total of four intermediate transfer rollers 24 are provided which correspond to each of the colors of the YMCK imaging stations Pa, Pb, Pc and Pd.

The intermediate transfer belt drive roller 22, the intermediate transfer belt-driven roller 23, and the transfer roller 24 stretch the intermediate transfer belt 21 and move the surface of the intermediate transfer belt 21 in a predetermined direction (the direction of arrow C in the drawing).

The intermediate transfer belt 21 moves in a circling motion in the direction of arrow C. The residual toner is removed and collected by the intermediate transfer belt cleaning device 25. The toner image of each color formed on the surface of each photoconductor drum 13 is successively transferred and superimposed, thereby forming a color toner image on the surface of the intermediate transfer belt 21.

The image forming device 1 is further provided with a secondary transfer device 26 which includes a transfer roller 26*a*. The transfer roller 26*a* has a nip portion formed between it and the intermediate transfer belt 21. A sheet transported through the sheet transport path 200 is transported by being sandwiched in the nip portion. When the sheet passes through the nip portion, the toner image on the surface of the intermediate transfer belt 21 is transferred onto the sheet.

A paper feed tray 18 provided in the paper feeder 17 is a tray for storing the sheets used for image formation, and is provided below the exposure device 11. Furthermore, the paper discharge tray 19 is provided above the image forming device 1, and is a tray for placing the sheets after image formation.

The sheet transport path 200 further includes a main path 201, and a reversal path 202 that branches off and later rejoins the main path 201. After a pickup roller 31 and a pre-registration roller 33, a registration roller 32, the secondary transfer device 26, the fixing device 10, and a paper discharge roller 34 are arranged along the main path 201. The reversal path 202 branches off between the fixing device 10 and the paper discharge roller 34, and rejoins between the pre-registration roller 33 and the registration roller 32 via the transport roller 35.

The pickup roller 31 is provided near the end of the paper feed tray 18, and is an introduction roller that supplies sheets one at a time from the paper feed tray 18 to the sheet transport path 200. The registration roller 32 temporarily holds a sheet being transported from the paper feed tray 18, and transports the sheet to the transfer roller 26*a* at a timing that enables the tip of the toner image on the photoconductor drum 13 and the tip of the sheet to be aligned. The pre-registration roller 33 is a small roller for promoting and assisting the transport of the sheet.

The fixing device 10 uses a belt fixing method, and includes a plurality of rotating members. A fixing belt 43 serving as a rotating member is suspended on a fixing roller 41 and a heating roller 42, which are also serving as rotating members (see FIG. 2 described below).

In the fixing device 10, the pressure roller 44 is pressed against the fixing roller 41 via the fixing belt 43. The fixing device 10 receives a sheet on which an unfixed image (toner image) has been formed, and transports the sheet by sandwiching it between the fixing belt 43 and the pressure roller 44. After fixing, the sheet is discharged onto the paper discharge tray 19 by the paper discharge roller 34.

When an image is formed not only on the front surface of the sheet but also on the rear surface, the sheet is transported from the paper discharge roller 34 to the reversal path 202 in the opposite direction to reverse the front and rear sides of the sheet. Then, the sheet is guided to the registration roller 32 again to perform image formation on the rear surface in the same manner as the front surface, and the sheet is transported to the paper discharge tray 19.

It is also possible to form a monochrome image using at least one of the four imaging stations Pa, Pb, Pc and Pd, and then transfer the monochrome image to the intermediate transfer belt 21 of the intermediate transfer belt device 16. The monochrome image is transferred from the intermediate transfer belt 21 to a sheet and fixed in the same manner as a color image.

Basic Configuration of Fixing Device

Next, the fixing device 10 according to an embodiment of the present invention will be described.

Figure 2:
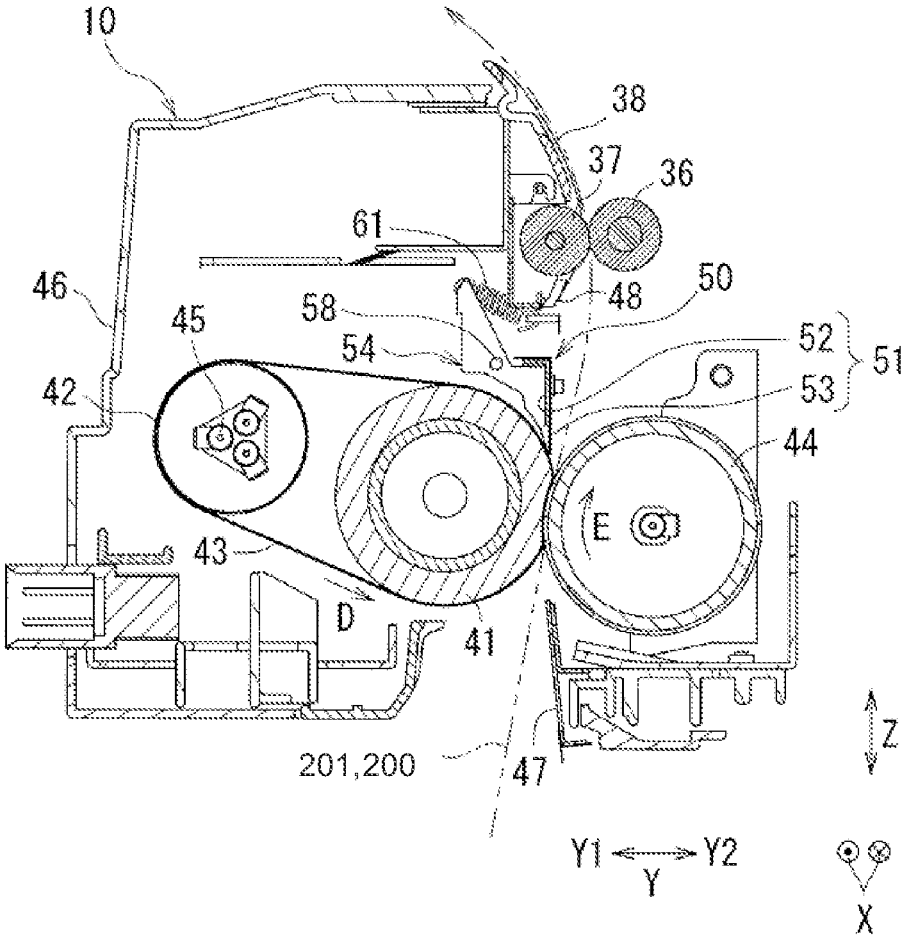
FIG. 2 is a schematic cross-sectional view showing a fixing device according to an embodiment of the present invention.

FIG. 2 is a schematic cross-sectional view showing the fixing device 10 according to the present embodiment. The fixing device 10 has a configuration in which a fixing roller 41, a heating roller 42, a fixing belt 43, and a pressure roller 44 serving as a rotating members are accommodated in a housing 46. In the fixing device 10, a sheet is sandwiched between the fixing roller 41 and the pressure roller 44, which presses against the fixing roller 41, via the fixing belt 43 suspended on the fixing roller 41 and the heating roller 42, and a toner image formed on the sheet is fixed.

The fixing roller 41 is a cylinder-shaped roller connected to a drive mechanism (not shown), and includes a core metal formed of stainless steel, and an elastic layer formed of silicon sponge rubber on the surface side of the core metal.

The heating roller 42 is a roller in which the interior is provided with a plurality of heating members 45. The heating members 45 are, for example, lamp heaters such as halogen lamps. The heat radiated from the heating members 45 heats the entire heating roller 42. As a result of using lamp heaters as the heating members 45, the fixing belt 43 can be heated over a wide area. Furthermore, by using inexpensive lamp heaters, the cost of the fixing device 10 can be reduced.

The pressure roller 44 corresponds to a pressing member in the fixing device 10, and has a core metal formed of an iron alloy (STKM), an elastic layer formed of silicon solid rubber around the core metal, a mold release layer formed of a PFA tube around the elastic layer, and the like. The pressure roller 44 is arranged at a position facing the fixing roller 41 via the fixing belt 43.

The fixing belt 43 is an endless belt that fixes an unfixed image on a sheet while transporting the sheet. The fixing belt 43 has configuration in which, for example, a base material formed of polyimide, an elastic layer formed of silicon rubber, and a release layer formed of a PFA tube are laminated in this order from the inside. The width direction of the fixing belt 43 is arranged in the axial direction X of the rotation axis of the fixing belt 43. The rear surface of the fixing belt 43 is in contact with the fixing roller 41, which has an elastic layer on the surface. As a result, the fixing belt 43 rotates in a synchronized fashion with the rotation of the fixing roller 41, and moves in a circling motion in the direction of arrow D.

The rotating members such as the fixing roller 41, the heating roller 42, the fixing belt 43, and the pressure roller 44 are accommodated inside the housing 46. The fixing roller 41, the heating roller 42, and the pressure roller 44 are arranged along the axial direction X. The fixing belt 43 has the belt width direction along the axial direction X.

In the fixing device 10, a drive mechanism (not shown) provided on the main body side of the image forming device 1 engages a gear (not shown) provided on the rotation axis of the fixing roller 41, and the rotational driving force from the drive mechanism is transmitted to the rotation axis of the fixing roller 41 via the gear. The fixing roller 41 is rotationally driven in a predetermined rotational direction. As the fixing roller 41 rotates, the fixing belt 43 moves in a circling motion in the same rotational direction D as the rotational direction of the fixing roller 41. The heating roller 42 is driven so as to rotate in the rotational direction E, which is the opposite direction to the rotational direction of the fixing roller 41. The sheet is transported while being sandwiched between the fixing belt 43 and the pressure roller 44, and is heated and pressurized in the fixing nip area. As a result, the unfixed image on the sheet is melted, mixed, pressed, and is thereby thermally fixed.

The housing 46 is made of, for example, a flame-retardant synthetic resin material, and is provided so as to entirely enclose the fixing roller 41, the heating roller 42, the fixing belt 43, and the pressure roller 44. The housing 46 is provided with a paper inlet 47 and a paper outlet 48 on the main path 201 through which a sheet passes. The paper inlet 47 is provided with a guide member.

A release member 51 is arranged near the fixing roller 41. The release member 51 separates a sheet which is making contact with the fixing roller 41, and guides the sheet to the paper outlet 48. The fixing belt 43 is arranged on a frame 62 which is arranged inside the housing 46.

After the unfixed image is fixed, the sheet is transported further upward and is discharged onto the paper discharge tray 19. If the sheet is discharged from the sandwiching part with the pressure roller 44 such that it is slightly wound on the fixing belt 43 side, the sheet is separated from the fixing belt 43 by the tip portion of the release member 51, and the separated sheet is transported upward and then discharged.

Sheet Separating Device

The sheet separating device 50 according to the present invention includes a release member 51. The release member 51 is provided so as to face the rotating members arranged on the main path 201 of the sheet transport path 200. In the present embodiment, the release member 51 is provided with respect to the fixing belt 43 of the fixing device 10.

That is to say, the sheet separating device 50 is provided facing the fixing belt 43 serving as a rotating member. The sheet separating device 50 separates and releases the transported sheet from the fixing belt 43 arranged on the sheet transport path 200, and is applied so as to prevent the sheet from becoming entangled.

Here, a release member having a conventional structure, such as a release claw, is positioned slightly separated from the surface of the fixing belt 43. Therefore, when the gap between the tip portion of the release claw and the fixing belt 43 becomes larger than a predetermined value, there is a concern that a sheet may enter the gap more easily and cause a paper jam. Further, if a sheet that has entered the gap continues to be transported while in close contact with the peripheral surface of the fixing belt 43, there is a concern that the sheet may become difficult to remove. In contrast, the fixing device 10 according to the present embodiment is provided with the sheet separating device 50 described below. As a result, the gap between the tip portion of the release member 51 and the fixing belt 43 is stably managed so that it is always a predetermined value. Further, the configuration prevents release problems caused by the sheet becoming wound around the peripheral surface of the fixing belt 43 before they occur.

Figure 3:
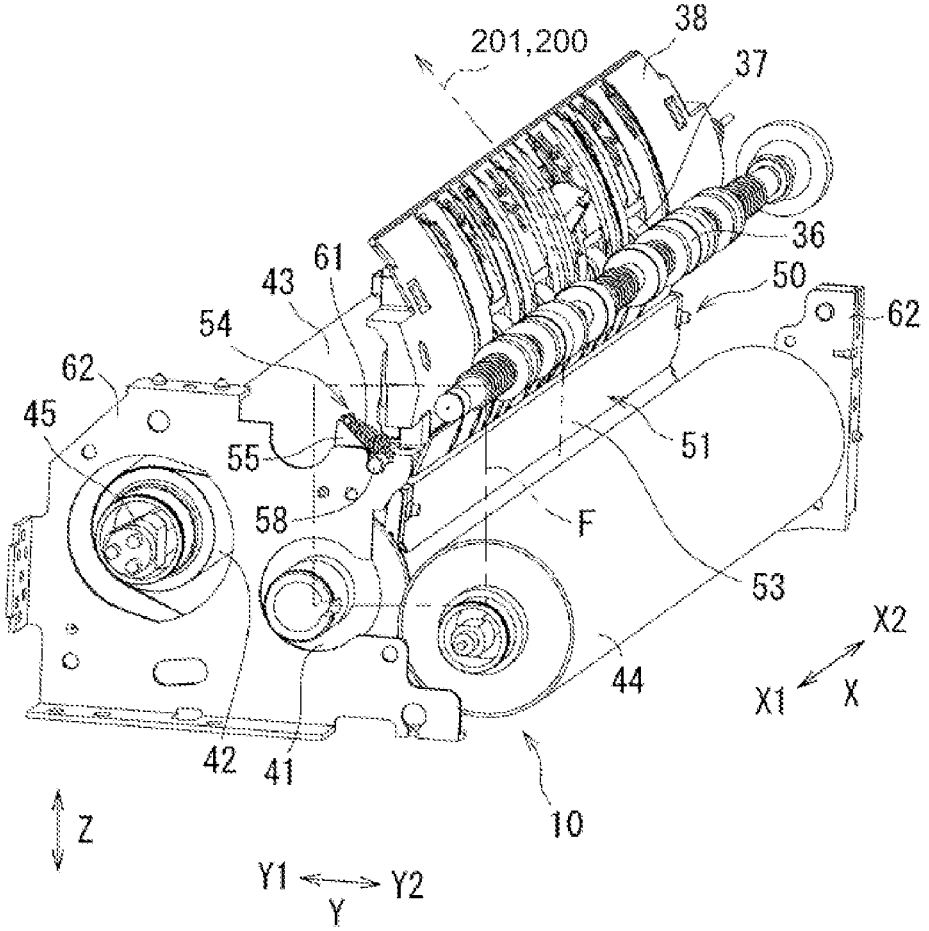
FIG. 3 is a perspective view showing a sheet separating device according to an embodiment of the present invention.
Figure 4:
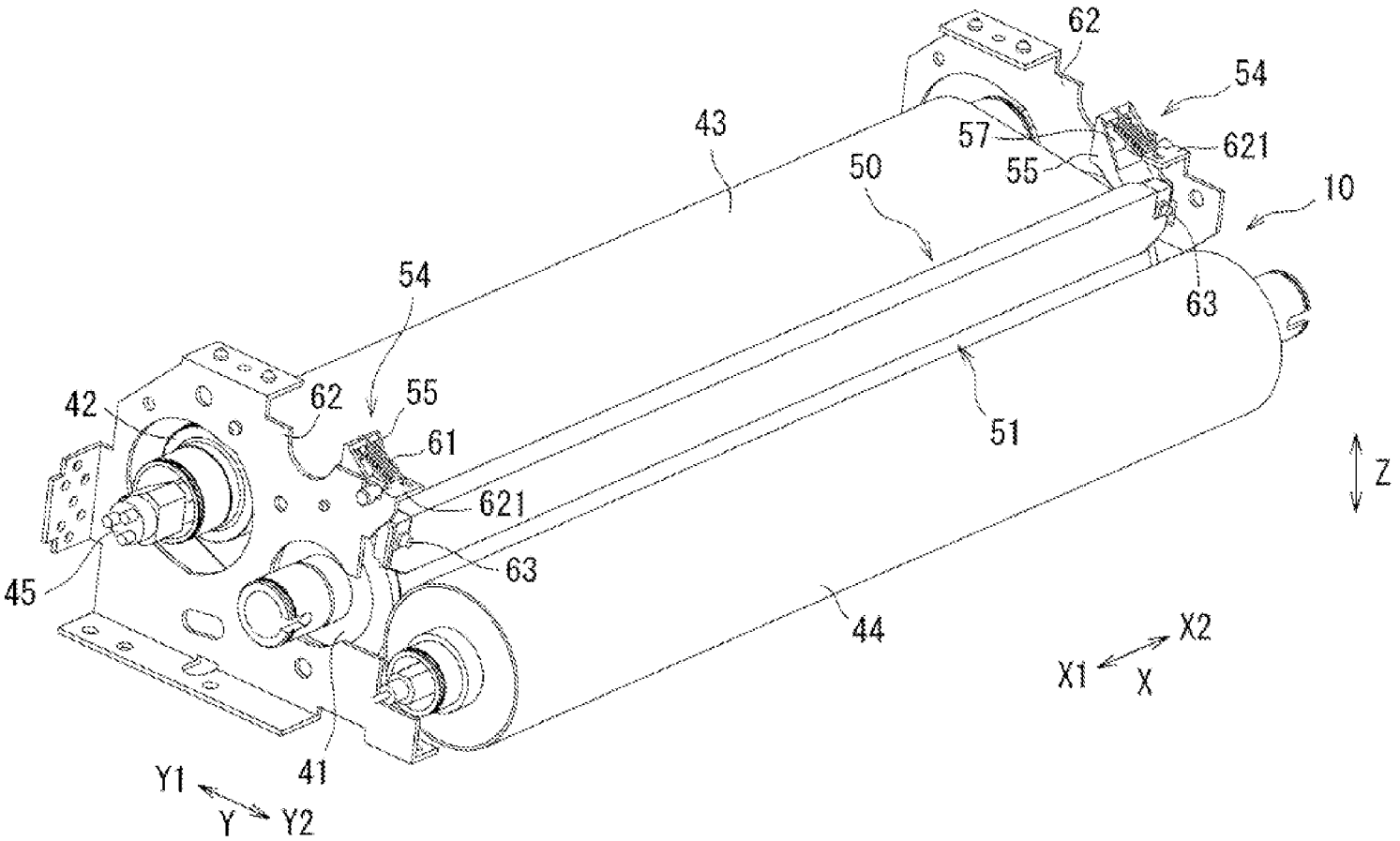
FIG. 4 is a perspective view showing the overall configuration of the sheet separating device.
Figure 5:
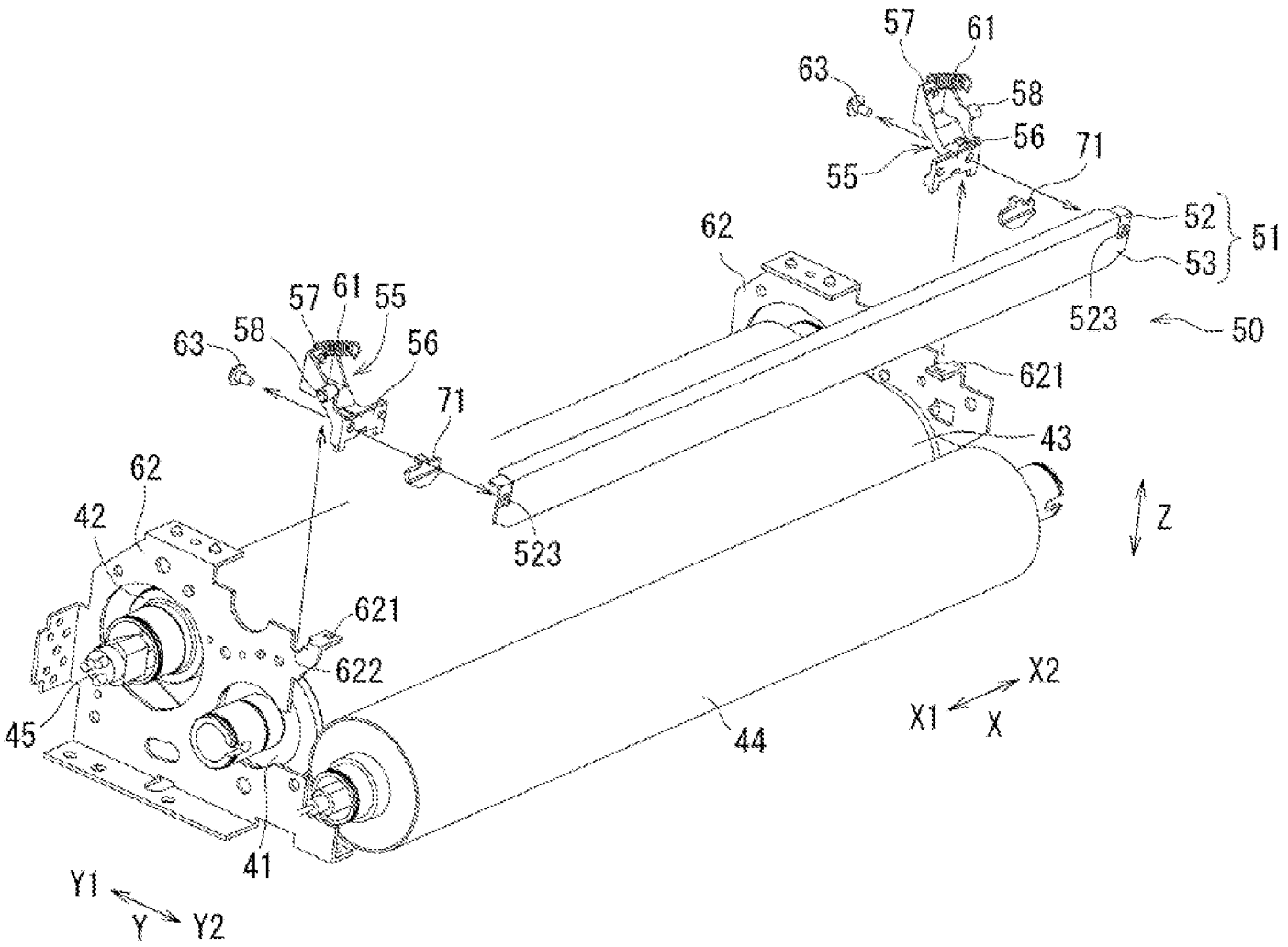
FIG. 5 is an exploded perspective view showing the sheet separating device.

FIG. 3 is a schematic perspective view of the sheet separating device 50 with the housing 46 of the fixing device 10 removed. FIG. 4 is a perspective view showing the overall configuration of the sheet separating device 50. FIG. 5 is an exploded perspective view of the sheet separating device 50. In each of the drawings, the bearings that rotatably support the heating roller 42, the fixing roller 41, and the pressure roller 44 have been omitted.

The sheet separating device 50 includes a release member 51, support members 54 that support the release member 51, and a separating tip portion 71. The release member 51 is a strip-shaped member which is elongated along the axial direction X. It has a tip portion which is provided so as to extend toward the surface of the fixing belt 43, and the longitudinal direction is arranged along the axial direction X.

A transport roller 36 and a transport skid 37 that form a pair are provided facing each other along the sheet transport path 200 above the sheet separating device 50. The transport skid 37 is provided on a sheet transport guide 38 constituting the sheet transport path 200. These enable the sheet to be delivered in the direction of the paper discharge roller 34.

The release member 51 is arranged below the sheet transport guide 38. That is to say, the release member 51 is arranged on the downstream side of the fixing belt 43 in the rotational direction D due to the fixing nip area formed by the pressure roller 44 and the fixing belt 43.

In the form described here as an example, as shown in FIG. 2 and FIG. 4, the release member 51 is provided with a support plate 52 which is fixed to the support members 54, and a release plate 53 which is attached to the support plate 52 and is made of a plate material which is thinner than the support plate 52. The support plate 52 and the release plate 53 are superimposed on each other and are supported as a single unit. Furthermore, the release plate 53 is arranged on the surface side of the support plate 52, which is the side facing the main path 201 of the sheet transport path 200. With regard to the release member 51 and the separating tip portion 71 constituting the sheet separating device 50, the following description assumes that the surface on the side provided along the axial direction X and arranged facing the main path 201 of the sheet transport path 200 is the front surface, and the opposite side to this is the rear surface.

As shown in FIG. 5, the release plate 53 is a plate-shaped member (such as sheet metal) that extends parallel to the rotation axis of the fixing roller 41, with the axial direction X as the longitudinal direction. It is substantially L-shaped when viewed from the axial direction X. More specifically, the release plate 53 is substantially L-shaped as a result of having a side plate arranged in the up-down direction Z, and a side plate which is bent and arranged in the left-right direction Y. The tip of the release plate 53 serves as the lower end of the side plate in the up-down direction Z, and is arranged downstream of the fixing nip area in the rotational direction D of the fixing belt 43. The support plate 52 is integrally provided on the rear surface side of the release plate 53, and is substantially L-shaped and makes close contact with the release plate 53.

The release member 51 is configured such that the release plate 53 is supported in a non-contact state with a predetermined gap (d) provided with respect to the fixing belt 43, and separates the sheet from the fixing belt 43. The release plate 53 is formed so as to have a surface area larger than that of the support plate 52, and the tip of the release plate 53 is provided so as to project further downward than the support plate 52. As a result, the tip of the release plate 53 constitutes the tip portion of the release member 51 and faces the surface of the fixing belt 43. Further, it is provided so as to make the gap (d) with the surface of the fixing belt 43 as narrow as possible.

The support members 54 are arranged at both ends in the axial direction X to support the release member 51. As shown in FIG. 4, the support members 54 support the release member 51 at both ends (a section outside the effective image area of the sheet) in the width direction of the fixing belt 43 (which corresponds to the axial direction X). The effective image area corresponds to, for example, the maximum area (specifically, 310 mm) in which an image is to be formed in the photoconductor drum 13 when an image is formed on a sheet having the maximum size (specifically, 330.2 mm [13 inches]).

Each support member 54 is provided with an arm member 55 that biases and holds the release member 51. As shown in FIG. 5, the arm member 55 is a member which is arranged above the fixing belt 43, where one end is provided with a fixing portion 56 with which the release member 51 makes contact, and the other end is provided with a biasing member locking portion 57 that locks the biasing member 61.

Figure 6:
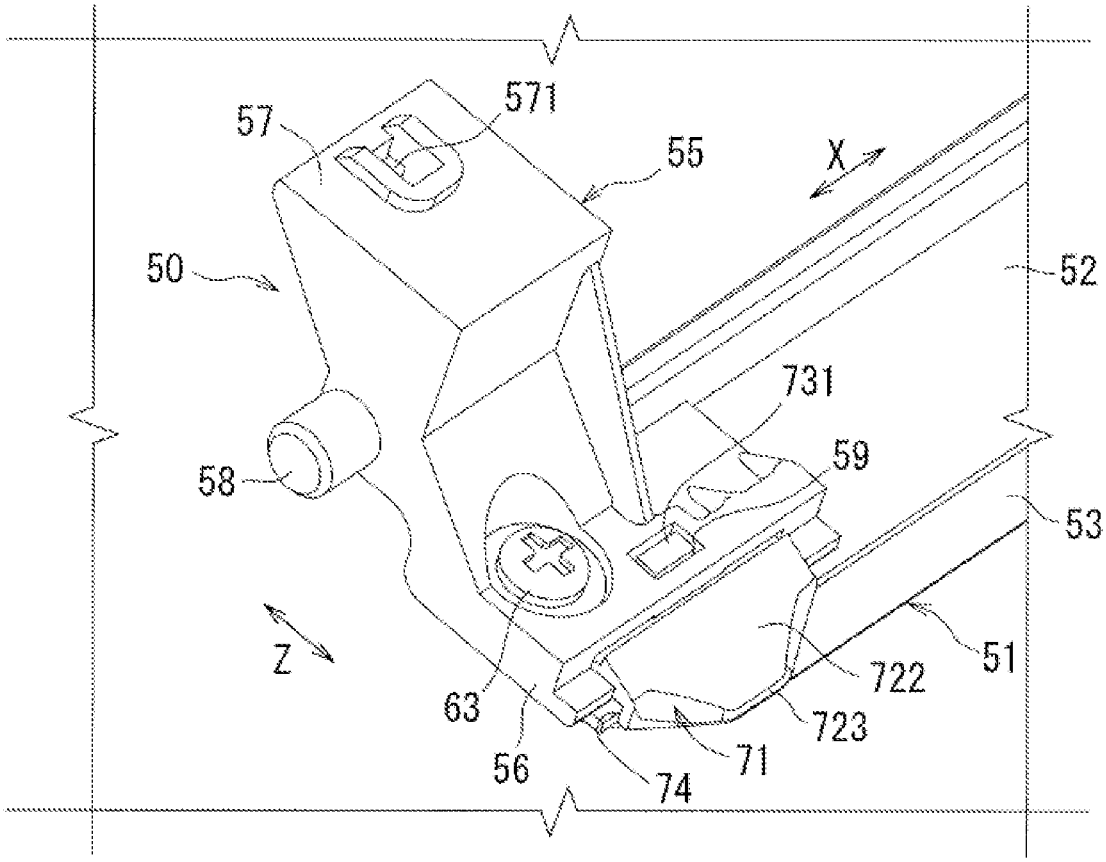
FIG. 6 is a perspective view showing a mounting structure of an arm member and a release member in the sheet separating device.
Figure 7A:
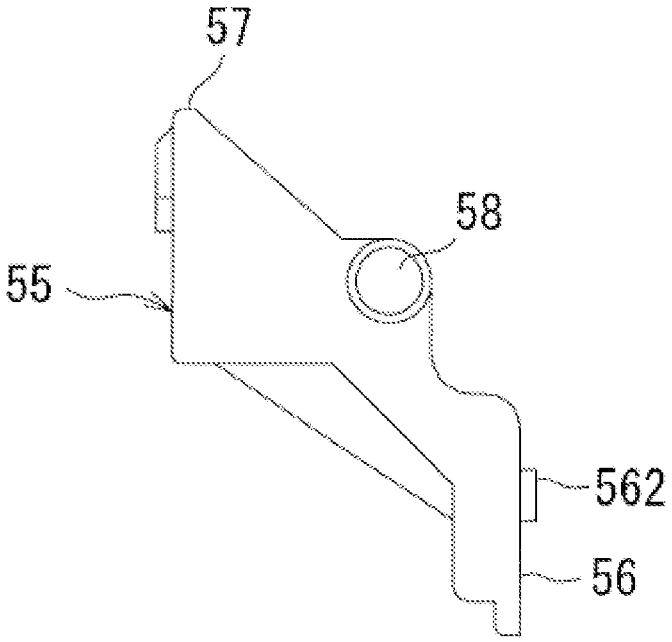
FIG. 7A is a front view showing the arm member.
Figure 7B:
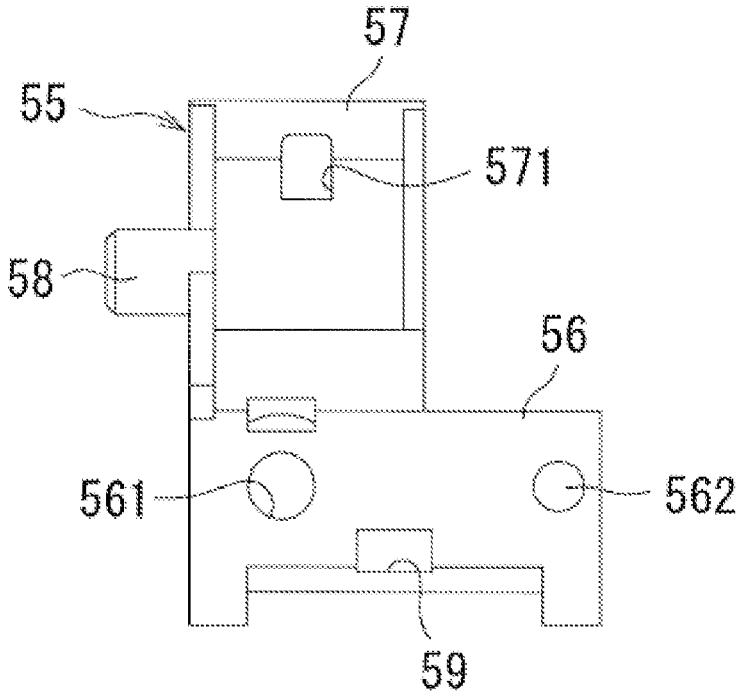
FIG. 7B is a side view of the arm member.
Figure 7C:
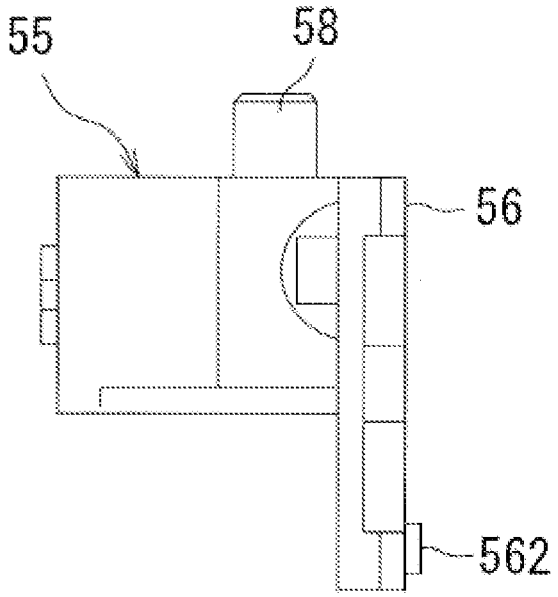
FIG. 7C is a bottom view of the arm member.

FIG. 6 is a perspective view showing a mounting structure of the arm member 55 and the release member 51. FIG. 7A to 7C are each showing the arm member 55. FIG. 7A is a front view showing the arm member 55 as viewed from the front X1 in the axial direction X shown in FIG. 5. FIG. 7B is a side view of the arm member 55 as viewed from the right side Y2 in the left-right direction Y. FIG. 7C is a bottom view of the arm member 55 as viewed from below.

As shown in the drawings, the arm member 55 has a support shaft 58 which is provided so as to project from a region between the fixing portion 56 and the biasing member locking portion 57. The support shaft 58 is provided so as to outwardly project along the axial direction X. As shown in FIG. 4 and FIG. 5, the arm member 55 is attached to the frame 62 which is opposingly arranged at the front X1 and the rear X2, and is rotatably supported with the support shaft 58 as the rotation center.

The fixing portion 56 of the arm member 55 makes contact with the rear surface of the support plate 52 of the release member 51 (the surface on the Y1 side in FIG. 5). The fixing portion 56 is provided with an insertion hole 561 through which a screw 63 for attaching the support plate 52 is inserted so as to penetrate both the front and rear surfaces. Furthermore, a boss portion 562 that locks and positions the support plate 52 is provided so as to project from the surface of the fixing portion 56.

The biasing member locking portion 57 of the arm member 55 is provided at the end (the end on the left side Y1 in FIG. 5) on the side further away from the sheet transport path 200 (main path 201), which is the opposite side to the fixing portion 56. The biasing member locking portion 57 has a flat plate portion extending in the up-down direction Z, and is provided with a locking hole 571 for locking the end of the biasing member 61. For example, one end of a coil spring serving as the biasing member 61 is locked in the locking hole 571. Furthermore, the other end of the biasing member 61 is locked to a locking portion 621 provided on the frame 62.

Figure 8:
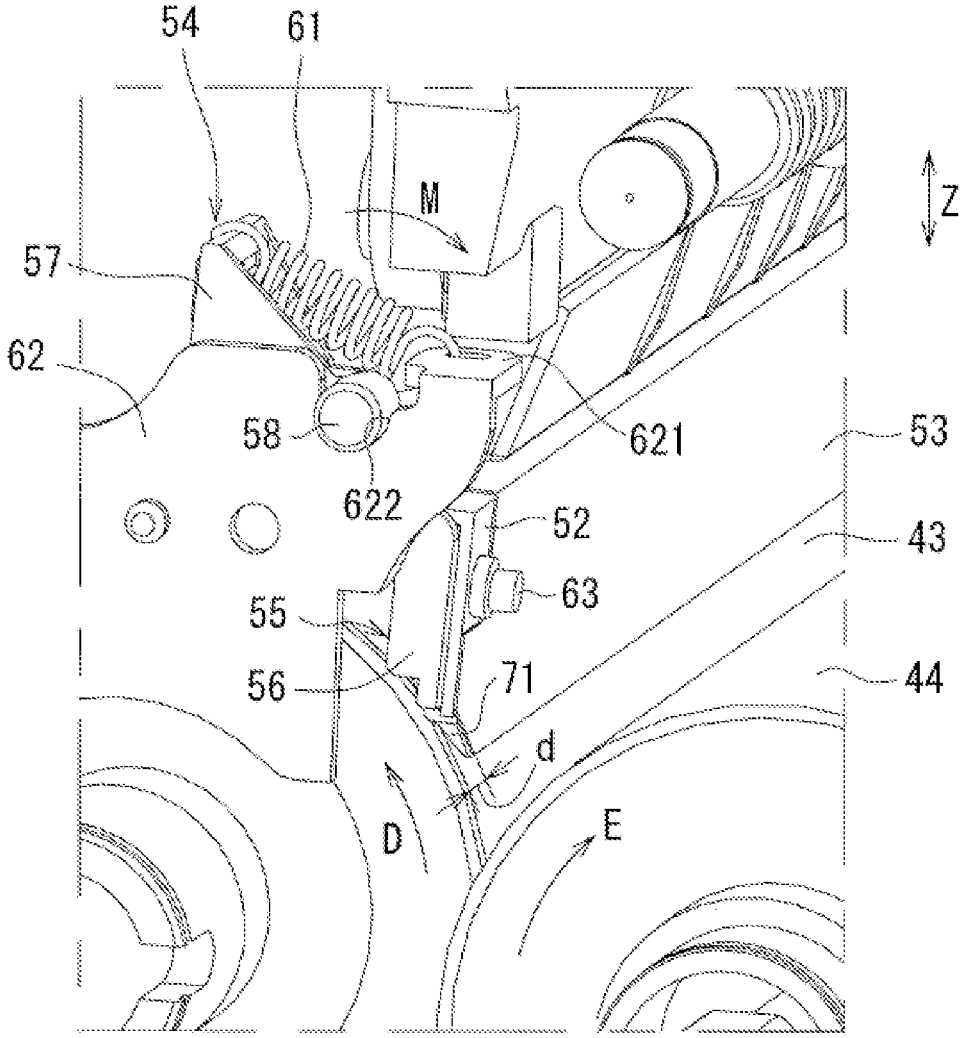
FIG. 8 is a perspective view showing a mounting structure of an arm member in the sheet separating device, and is an enlarged view of section F in FIG. 3.

FIG. 8 is a perspective view showing a mounting structure of the arm member 55 in the sheet separating device 50, and is an enlarged view of section F in FIG. 3. As shown in FIG. 5 and FIG. 8, the support plate 52 having the release plate 53 is fixed to the fixing portion 56 on one end of the arm member 55 with a screw 63. A biasing member 61 is locked to the other end of the arm member 55. The support shaft 58 is notched in a concave shape and is held by a receiving portion 622 provided on the frame 62.

As a result, the arm member 55 is rotatable with the support shaft 58 as the rotation center. Further, it is biased by the biasing member 61 in the rotational direction, which narrows the distance between the locking portion 621 of the frame 62 and the biasing member locking portion 57. Therefore, the release member 51 attached to the fixing portion 56 on the opposite side to the biasing member locking portion 57 of the arm member 55 is supported in a state where it is biased in the surface direction of the fixing belt 43.

In the example shown in FIG. 8, the arm member 55 is biased by the biasing member 61 in a biasing direction indicated by arrow M around the support shaft 58. The fixing portion 56 of the arm member 55 is also biased in the direction of arrow M about the support shaft 58. The release plate 53 attached to the fixing portion 56 is also biased in the direction of arrow M. As a result of the bias of the arm member 55, the tip of the release plate 53 is held in a state where it is biased toward the surface of the fixing belt 43. The gap d between the tip of the release plate 53 and the surface of the fixing belt 43 should be as narrow as possible, and is preferably, for example, about 0.5 mm.

Here, in order to appropriately maintain the gap d between the tip of the release plate 53 and the surface of the fixing belt 43, the sheet separating device 50 is further provided with the separating tip portion 71. As shown in FIG. 6 and FIG. 7B, in the arm member 55, the fixing portion 56 is provided with a storage portion 59. In the form described here as an example, the storage portion 59 is a rectangular through hole penetrating both the front and rear surfaces of the fixing portion 56. A first protrusion 731 provided on the separating tip portion 71 is fitted and held in the storage portion 59. Because there is a gap between the storage portion 59 and the first protrusion 731, the separating tip portion 71 is rotatably (movably) supported with respect to the storage portion 59.

Figure 9A:
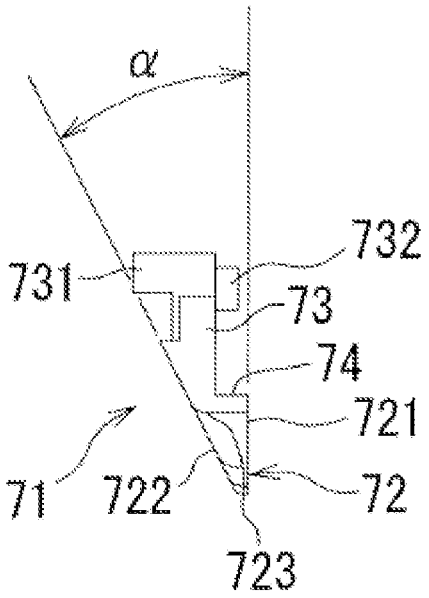
FIG. 9A is a front view showing a separating tip portion of the sheet separating device.
Figure 9B:
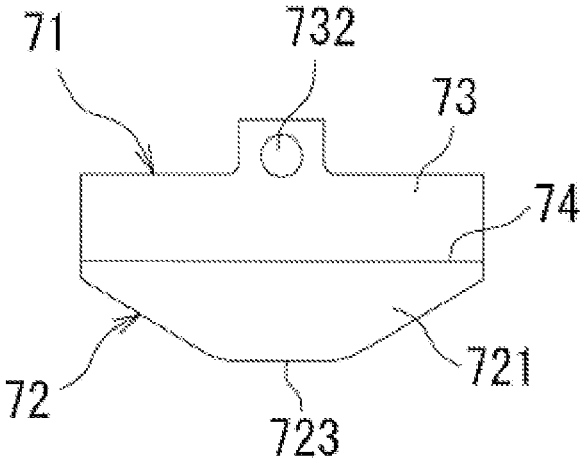
FIG. 9B is a side view of the separating tip portion.
Figure 9C:
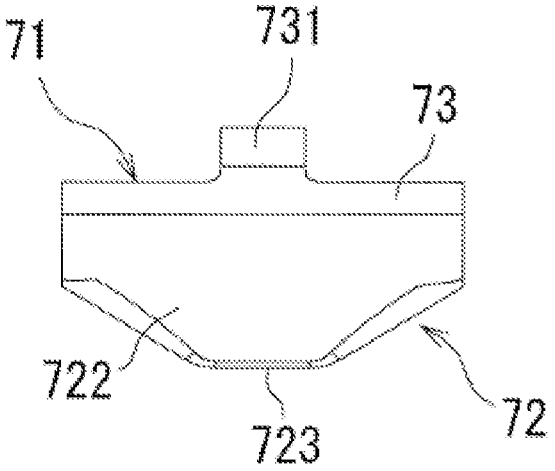
FIG. 9C is a side view of the separating tip portion viewed from the opposite side of FIG. 9B.
Figure 9D:
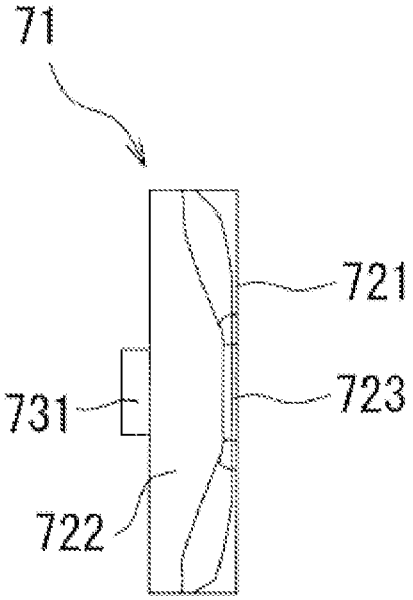
FIG. 9D is a bottom view of the separating tip portion.

FIG. 9A to FIG. 9D are each showing the separating tip portion 71. FIG. 9A is a front view showing the separating tip portion 71 as viewed from the front X1 in the axial direction X shown in FIG. 5. FIG. 9B is a side view of the separating tip portion 71 as viewed from the right side Y2 in the left-right direction Y. FIG. 9C is a side view from the opposite side of FIG. 9B. FIG. 9D is a bottom view of the separating tip portion 71 as viewed from below.

As shown in the drawings, the separating tip portion 71 is provided with a sliding contact portion 72 having a first contact surface 721 that makes contact with the tip portion of the release member 51, and a second contact surface 722 that makes contact with the surface of the fixing belt 43. The downstream side of the sliding contact portion 72 in the rotational direction D of the fixing belt 43 is provided with an opposing portion 73 that extends toward the fixing portion 56, and a first protrusion 731 that projects from the opposing portion 73 toward the storage portion 59. The separating tip portion 71 is attached with an orientation such that the first protrusion 731 is located above, and the sliding contact portion 72 is located below the fixing portion 56 of the arm member 55.

In the sliding contact portion 72, the thickness between the first contact surface 721 and the second contact surface 722 is formed so as to gradually decrease toward the lower side. The thickness of the tip 723 of the sliding contact portion 72 is formed so as to correspond to a suitable gap d between the tip of the release plate 53 and the surface of the fixing belt 43. Furthermore, as shown in FIG. 9B, the sliding contact portion 72 has a substantially trapezoidal surface shape in which the width becomes narrower toward the tip 723 side, and the corner portion is provided with a curvature.

As shown in FIG. 6, the opposing portion 73 of the separating tip portion 71 is arranged on the rear surface side of the support plate 52 of the release member 51. Further, the tip 723 is provided so as to be located on the tip side of the release plate 53. The first contact surface 721 is arranged in an orientation that makes contact with the release plate 53.

As a result, the separating tip portion 71 is arranged so that the tip 723 of the sliding contact portion 72 faces the fixing nip area formed by the pressure roller 44 and the fixing belt 43. Furthermore, as shown in FIG. 8, the separating tip portion 71 is formed so that the thickness gradually decreases toward the upstream side of the rotational direction D of the fixing belt 43. As a result of having such a shape, the separating tip portion 71 is configured so as to not bite into the fixing belt 43, while also ensuring the gap d is formed between the release plate 53 and the fixing belt 43.

The opposing portion 73 of the separating tip portion 71 is provided between the fixing portion 56 of the arm member 55 and the support plate 52 of the release member 51, and extends from the sliding contact portion 72 toward the fixing portion 56 side such that it does not make contact with the support plate 52. As a result of such a configuration, the separating tip portion 71 is capable of swinging with respect to the storage portion 59 with certainty. Therefore, the first contact surface 721 and the second contact surface 722 of the sliding contact portion 72 are each capable of making contact with the tip portion of the release plate 53 and the surface of the fixing belt 43 with certainty. That is to say, the gap between the tip portion of the release plate 53 and the fixing belt 43 can be managed at a target value d with certainty. The opposing portion 73 is provided extending above the sliding contact portion 72 via a third contact surface 74.

As shown in FIG. 9A to 9C, the third contact surface 74 is formed above the sliding contact portion 72 by providing a step which is recessed from the surface side having the first contact surface 721 toward the rear surface side. The first protrusion 731 and the second protrusion 732 are provided so as to project from the opposing portion 73. The first protrusion 731 is provided so as to project from the rear surface of the opposing portion 73, and is formed with a rectangular cross section. The second protrusion 732 is provided so as to project from the surface of the opposing portion 73, and extends in the opposite direction to the first protrusion 731. The second protrusion 732 is formed with a circular cross section.

As described above, and as shown in FIG. 6, the first protrusion 731 is fitted and held in the storage portion 59 of the arm member 55. The second protrusion 732 is fitted into an elongated hole-shaped regulator 521 provided so as to penetrate the support plate 52 of the release member 51.

Figure 10:
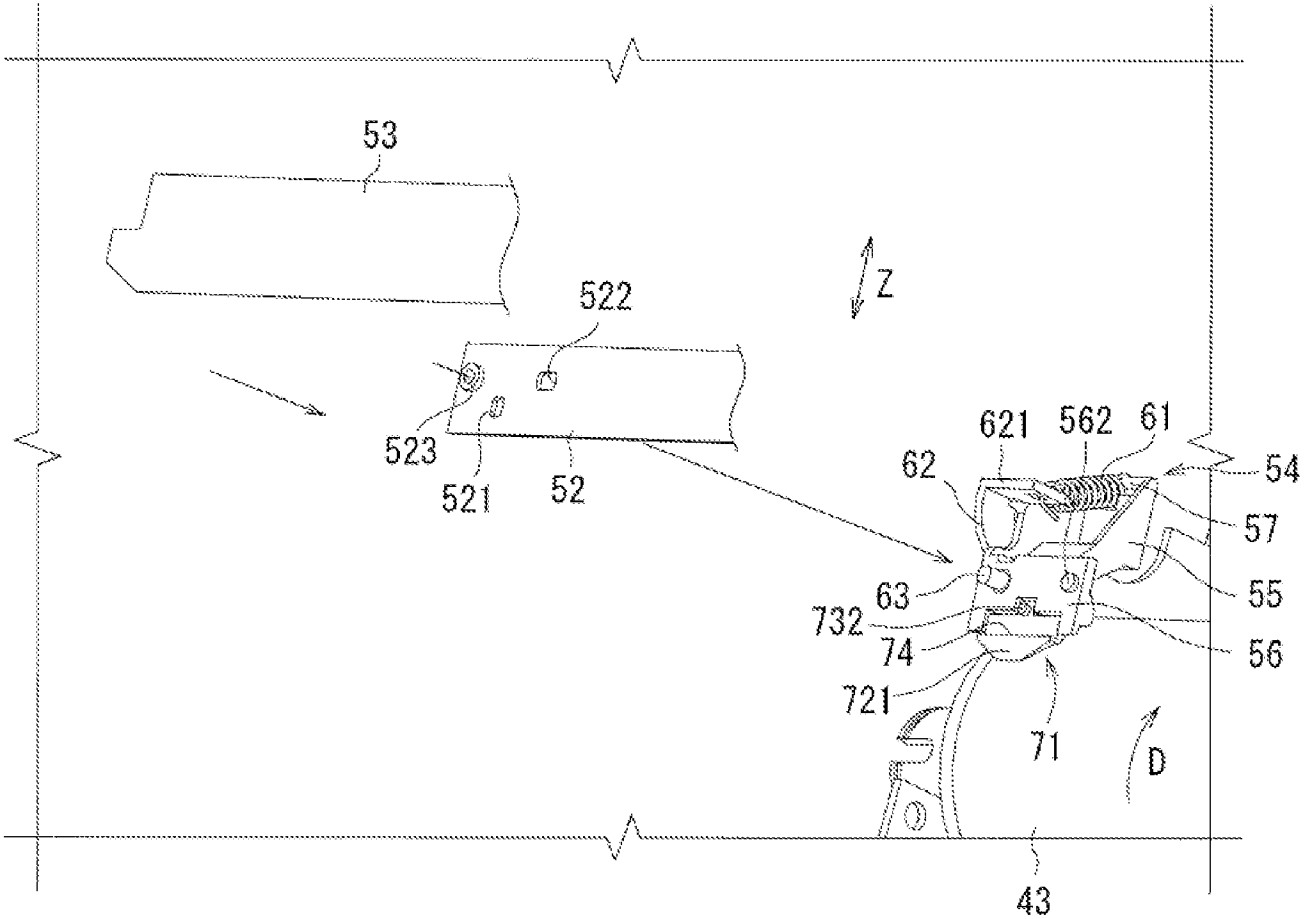
FIG. 10 is an exploded perspective view showing a mounting structure of the release member and the arm member.

FIG. 10 is an exploded perspective view showing a mounting structure of the release member 51 and the arm member 55. As shown in the drawing, a regulator 521, a positioning hole 522, and a fastening hole 523 for attaching the members are opened at the end of the support plate 52 of the release member 51 so as to penetrate both the front and rear surfaces.

The regulator 521 is formed having an elongated hole shape which is elongated in the up-down direction Z. It holds the second protrusion 732, and regulates the range of movement of the second protrusion 732. In other words, as a result of the elongated hole of the regulator 521, the movement direction of the second protrusion 732 is regulated so that it is movable in the rotational direction D of the fixing belt 43. The boss portion 562 of the fixing portion 56 of the arm member 55 is fitted to the positioning hole 522. A screw 63 is inserted into the fastening hole 523 through the insertion hole 561 of the fixing portion 56. The support plate 52 and the arm member 55 are joined in a state where the separating tip portion 71 is sandwiched between them. As shown in FIG. 6 and FIG. 10, the tip side end of the support plate 52 (the lower end) is arranged so as to face the third contact surface 74 of the separating tip portion 71.

As a result of the above configuration, the separating tip portion 71 is swingably supported with respect to the fixing portion 56. Further, the first contact surface 721 and the second contact surface 722 of the sliding contact portion 72 are each capable of making contact with the tip portion of the release plate 53 and the surface of the fixing belt 43. In addition, even if a force moving in the rotational direction D of the fixing belt 43 due to a frictional force acts on the sliding contact portion 72 of the separating tip portion 71, which is pressed against the fixing belt 43 via the tip portion of the release plate 53, the movement direction of the separating tip portion 71 is regulated by the second protrusion 732 to the rotational direction D of the fixing belt 43. Further, because the third contact surface 74 makes contact with the end of the support plate 52, the separating tip portion 71 is positioned and locked in a direction orthogonal to the rotational direction D of the fixing belt 43. Therefore, the sliding contact portion 72 of the separating tip portion 71 makes stable contact with the fixing belt 43. Consequently, even when the separating tip portion 71 is biased by the fixing belt 43 via the tip portion of the release plate 53, the gap between the tip of the release plate 53 and the fixing belt 43 can be stably managed at a target value d with certainty (because the contact friction force becomes stable).

Figure 11:
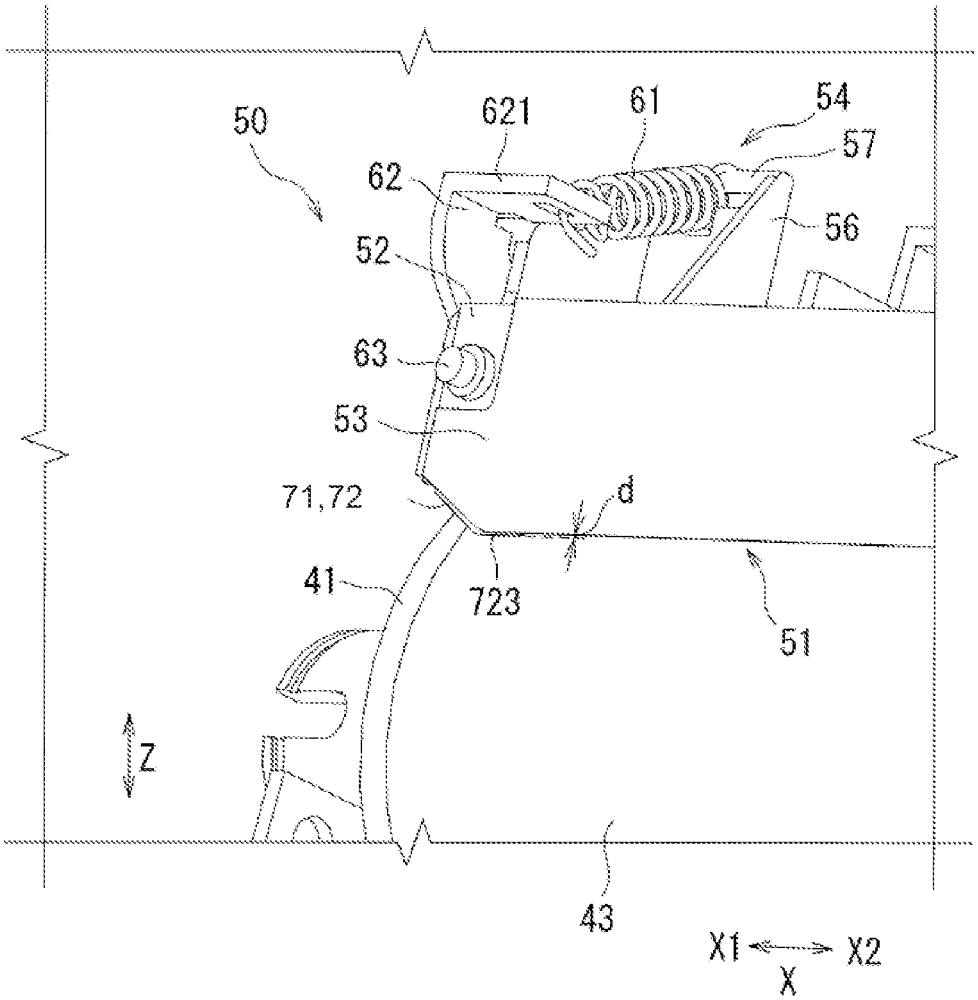
FIG. 11 is a perspective view showing the release member and a fixing roller of the fixing device.
Figure 12:
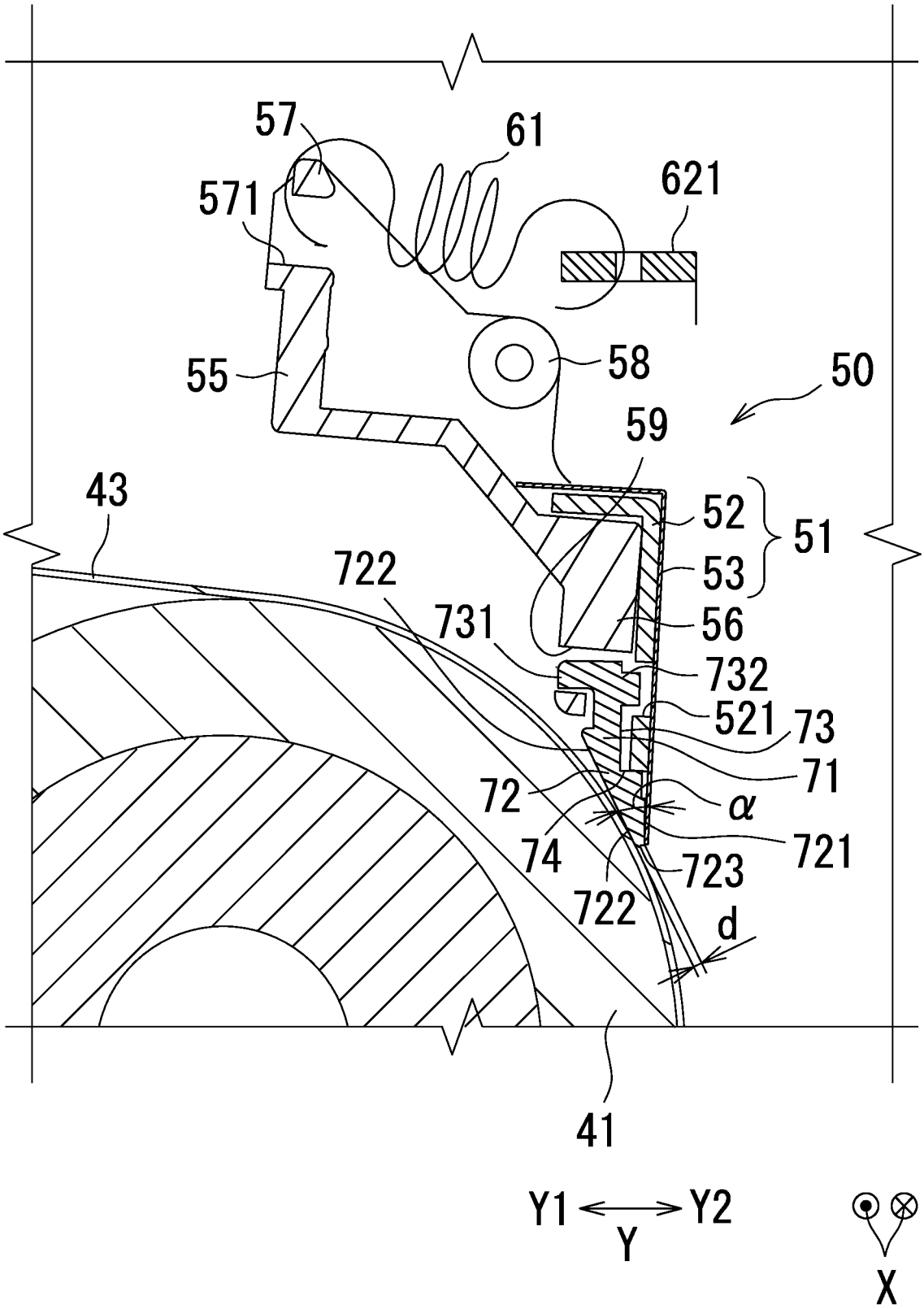
FIG. 12 is a cross-sectional view showing an arrangement of the release member and the fixing roller.

FIG. 11 is a perspective view showing the release member 51 and the fixing roller 41 as viewed from the main path 201 side. FIG. 12 is a cross-sectional view showing the arrangement of the release member 51 and the fixing roller 41 as viewed in the axial direction X.

As described above, separating tip portions 71 are arranged at both ends of the fixing roller 41 in the axial direction X, and each of these are swingably held between the arm member 55 and the release member 51. Furthermore, at both ends of the fixing belt 43, the separating tip portions 71 are located between the tip of the release plate 53 of the release member 51 and the surface of the fixing belt 43, and are provided so as to make contact with the surface of the fixing belt 43.

As a result, the thickness of the sliding contact portion 72 of the separating tip portion 71 maintains a constant gap d between the tip of the release plate 53 and the surface of the fixing roller 41. In addition, in the separating tip portion 71, the sliding contact portion 72 is formed so as to become thinner toward the tip 723 side. Therefore, the gap d can be set narrower.

In the separating tip portion 71, the sliding contact portion 72 is formed such that the thickness decreases toward the tip 723 side. The release plate 53 is stably positioned as a result of an intersection angle $\alpha$ between the first contact surface 721 and the second contact surface 722 being formed so as to correspond to a suitable gap d between the surface of the fixing belt 43 and the tip of the release plate 53.

Figure 13:
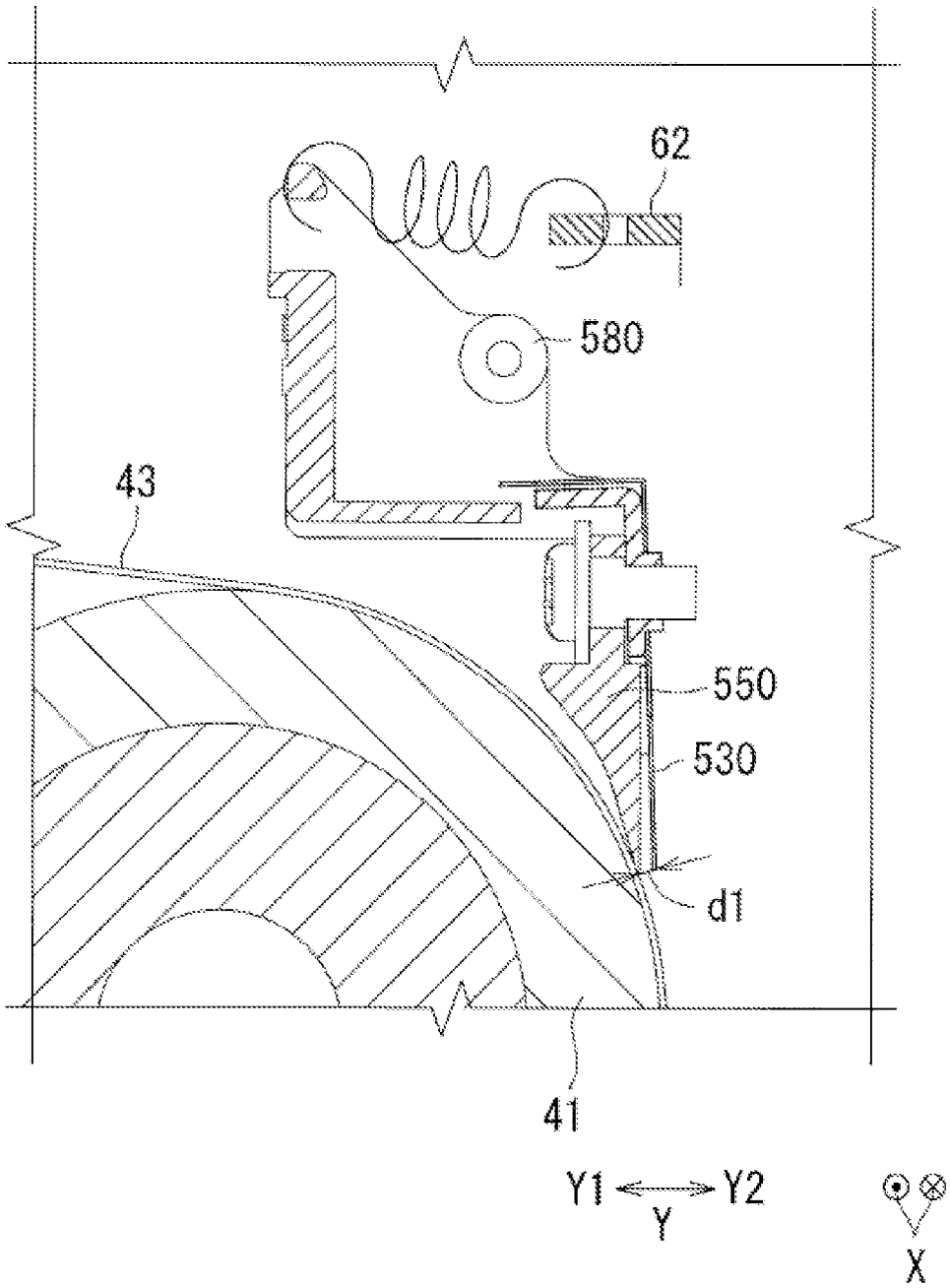
FIG. 13 is a cross-sectional view of a reference example shown for comparison with the sheet separating device according to the present embodiment.

As shown in the reference example in FIG. 13, if a release plate 530 having a conventional structure is fixed to a support member 550 having a support shaft 580 using a screw or the like, and is provided such that it is unable to swing, when the tip portion of the release plate 530 becomes bent due to long-term use, or the release plate 530 is attached at an angle to the support member 550, there is a concern that the gap dl between the surface of the fixing roller 41 and the release plate 530 may become wider than the target value, causing a sheet to become entangled in the gap. In contrast, in the case of the present embodiment shown in FIG. 11 and FIG. 12, it is possible to maintain the gap d at a fixed target value via the separating tip portion 71, which is swingably held. As a result, it is possible to continuously perform image forming processing without the need to perform adjustment operations and the like for managing a suitable gap.

Furthermore, the surface side of the release plate 53 is not provided with any protrusions. Therefore, the sheet separating device 50 can be arranged so as to face the main path 201 of the sheet transport path 200. Further, there is no need to increase the length of the fixing belt 43 or the fixing roller 41, and it becomes possible to reduce the size of the fixing device 10.

Note that the separating tip portion 71, which is swingably provided with respect to the support member 54, is not limited to being held between the arm member 55 and the release member 51 as in the form described here as an example, and may be provided in any manner as long as it has a swingable configuration. For example, the opposing portion 73 of the separating tip portion 71 may be formed of an elastic member and integrally connected to the arm member 55. As a result of such a configuration, when the sliding contact portion 72 is biased toward the fixing belt 43 side via the tip portion of the release plate 53, the opposing portion 73 bends, and the first contact surface 721 and the second contact surface 722 of the sliding contact portion 72 each make contact with the tip portion of the release plate 53 and the surface of the fixing belt 43 with certainty. Therefore, the gap between the tip of the release plate 53 and the fixing belt 43 can be stably managed at a target value d with certainty. Furthermore, by forming a portion of the opposing portion 73 that has been integrally formed with the arm member 55 to have a smaller longitudinal direction cross section, the same effect can be obtained even when a configuration is used in which the opposing portion 73 can be easily bent.

The image forming device 1 provided with the fixing device 10 as described above is not limited to a color image forming device that forms a multicolor or monochrome image on a sheet, and may be an image forming device that forms a monochrome image. In the case of a monochrome image forming device, it is preferable that a silicon sponge is used for the elastic layer around the core metal of the pressure roller 44. In this case, by providing the sheet separating device 50 in the same manner as in the present embodiment, the effect of smoothly guiding the sheet to the sheet transport path 200 can be obtained. In the fixing device 10, the sheet separating device 50 may be provided facing, among the rotating members, the fixing roller 41, which fixes an unfixed image on the sheet while transporting the sheet with the pressure roller 44.

Furthermore, the respective shapes and arrangements of the support member 54 and the separating tip portion 71 of the sheet separating device 50 are not limited to the configurations presented in the embodiment described above, and may be provided in any manner. As such, the embodiment described above is an example and is not limiting. The present invention can be modified in various ways within the scope of the claims, and embodiments obtained by appropriately combining the technical means disclosed in the different embodiments are also included in the technical scope of the present invention.

What is claimed is:

1. A sheet separating device including: a rotating member that sandwiches a sheet with an opposing member, and transports the sheet by rotating;

a release member which has a plate shape and is arranged along a rotation axis direction of the rotating member, and which includes, downstream of a sheet sandwiching part of the rotating member in a sheet transport direction, a tip portion that extends toward the rotating member;

support members that each support the release member at both ends in the rotation axis direction; and a separating tip portion which is arranged between the tip portion of the release member and the rotating member, and which is swingably attached with respect to each of the support members, wherein the tip portion of the release member is disposed toward an upstream side in a rotational direction of the rotating member, the separating tip portion is provided with a sliding contact portion having: a first contact surface that is arranged between the release member and the rotating member and that makes contact with a surface of the tip portion of the release member, the surface facing the rotating member; and a second contact surface that is on a side opposite to the first contact surface and that makes contact with a surface of the rotating member, and a thickness between the first contact surface and the second contact surface decreases toward the upstream side in the rotational direction of the rotating member.

2. The sheet separating device according to claim 1, wherein the separating tip portion is provided with an opposing portion on a downstream side in a rotational direction of the rotating member that extends so as to not make contact with the release member, the opposing portion is provided with a first protrusion which projects toward the support members, and the support members are provided with a storage portion that accommodates the first protrusion and swingably holds the separating tip portion.

3. The sheet separating device according to claim 2, wherein the opposing portion is further provided with a second protrusion that projects toward the release member, and the release member is provided with a regulator that accommodates the second protrusion and regulates a range of movement of the second protrusion with respect to the release member.

4. The sheet separating device according to claim 1, wherein the release member is provided with a support plate which is fixed to the support members, and a release plate which is attached to the support plate and is made of a plate material which is thinner than the support plate, and an end of the release plate on the rotating member side is provided so as to project further from an end of the support plate on the rotating member side, and constitutes the tip portion.

5. The sheet separating device according to claim 4, wherein the separating tip portion has a third contact surface which is provided so as to face an end of the support plate on the rotating member side.

6. The sheet separating device according to claim 1, wherein the support member is provided with a fixing portion on one end to which the release member is fixed, and a locking portion of a biasing member on another end, and is rotatably supported around a rotation center between the fixing portion and the locking portion, and the release member is biased in a surface direction of the rotating member.

7. A fixing device including the sheet separating device according to claim 1, wherein the rotating member is a fixing roller which fixes an unfixed image on a sheet while transporting the sheet with a pressing member, or the rotating member is an endless fixing belt that fixes an unfixed image on a sheet while transporting the sheet, and an opposite side of the fixing belt at a position corresponding to the release member makes contact with a fixing roller having an elastic layer on a surface.

8. An image forming device including the fixing device according to claim 7.

* * * * *